US009523173B1

(12) United States Patent
Tonello

(10) Patent No.: US 9,523,173 B1
(45) Date of Patent: Dec. 20, 2016

(54) PRESS APPARATUS

(71) Applicant: PMT ITALIA S.L.A.

(72) Inventor: Fabrizio Tonello, Cervasca (IT)

(73) Assignees: PMT ITALIA S.L.A., Pinerolo (Torino) (IT); CHINA PAPER MACHINERY CORP., Beijing (CN)

( * ) Notice: Subject to any disclaimer, the term of this patent is extended or adjusted under 35 U.S.C. 154(b) by 872 days.

(21) Appl. No.: 13/859,686

(22) Filed: Apr. 9, 2013

(51) Int. Cl.
*D21F 3/04* (2006.01)
*D21F 3/02* (2006.01)

(52) U.S. Cl.
CPC ..... *D21F 3/04* (2013.01); *D21F 3/0209* (2013.01)

(58) Field of Classification Search
CPC ..... D21F 3/00; D21F 3/02
USPC ..... 162/358.3, 358.4, 358.1; 100/37, 118, 100/153, 156
See application file for complete search history.

(56) References Cited

U.S. PATENT DOCUMENTS 4,707,222 A * 11/1987 Mullner ..... D21F 3/0245 100/121
6,210,530 B1 * 4/2001 Loser ..... D21F 3/045 162/205
6,254,728 B1 * 7/2001 Henssler ..... D21F 3/02 162/203
6,886,456 B2 * 5/2005 Tonello ..... D21F 3/0245 100/153
7,811,419 B2 * 10/2010 Tonello ..... D21F 3/0218 100/153
2002/0092639 A1 * 7/2002 Ishii ..... D21F 3/0227 162/358.2
2007/0028481 A1 * 2/2007 Gronych ..... D21F 3/045 34/397
2012/0111516 A1 * 5/2012 Tynkkynen ..... B05B 15/0406 162/133

* cited by examiner

*Primary Examiner* — Mark Halpern
(74) *Attorney, Agent, or Firm* — David J. Archer

(57) ABSTRACT

A press apparatus is disclosed for removing water from a web that has been supported on an upstream forming wire. The press apparatus includes a first roll which cooperates with the forming wire for transferring the web from the forming wire to the first roll, the first roll being a suction roll. A second roll is disposed downstream relative to the first roll, the second roll cooperating with the first roll for defining therebetween a first nip for the removal of a first portion of the water from the web during passage of the web through the first nip. The second roll is a suction roll. A third roll is disposed downstream relative to the second roll, the third roll cooperating with the second roll for defining therebetween a second nip for the removal of a second portion of the water from the web during passage of the web through the second nip. The third roll is a plain roll. A looped first press felt extends around the first roll and through the first nip such that the first press felt supports the web from the forming wire to the first nip, the first press felt being disposed between the web and the first roll from the forming wire to the first nip. Also, a looped second press felt extends around the second roll and through the first nip such that the second press felt supports the web from the first nip to the second nip, the second press felt being disposed between the web and the second roll from the first nip to the second nip.

22 Claims, 9 Drawing Sheets

PRESS APPARATUS

FIELD OF THE INVENTION

Background of the Invention

The present invention relates to a press apparatus for removing water from a web.

More specifically, the present invention relates to a press apparatus for removing water from a web that has been supported on an upstream forming wire.

Background Information

In a typical prior art press apparatus, the formed web is transferred from a forming wire by a press transfer felt extending around a pick up roll. The formed web is thereafter supported on and guided by the press transfer felt between counter rotating rolls defining therebetween a press nip for the removal of water from the formed web.

The present invention provides a unique press apparatus in which the pick up roll also doubles up as a press roll so that when suction is applied to the pick up roll, the formed web is picked up and removed by a press transfer felt extending around the pick up roll. Immediately thereafter, while still being supported by the pick up roll, the formed web supported on the press transfer roll is passed through a first nip defined between the pick up roll and a cooperating counter press roll.

The present invention therefore provides a very compact press arrangement and avoids the expense of providing both a pick up roll and a first press roll because the pick up roll serves the dual purpose of a pick up roll and a first press roll.

Therefore, it is a primary feature of the present invention to provide a press apparatus for removing water from a web that overcomes the problems associated with the prior art arrangements.

Another feature of the present invention is the provision of a press apparatus that is extremely compact and which avoids rewetting of the pressed web.

A further feature of the present invention is the provision of a press apparatus that imparts a printable surface to the resultant pressed web.

Other features and advantages of the present invention will be readily apparent to those skilled in the art by a consideration of the detailed description of a preferred embodiment of the present invention contained herein.

SUMMARY OF THE INVENTION

The present invention relates to a press apparatus for removing water from a web that has been supported on an upstream forming wire. The press apparatus includes a first roll which cooperates with the forming wire for transferring the web from the forming wire to the first roll, the first roll being a suction roll. A second roll is disposed downstream relative to the first roll, the second roll cooperating with the first roll for defining therebetween a first nip for the removal of a first portion of the water from the web during passage of the web through the first nip. The second roll is a suction roll. A third roll is disposed downstream relative to the second roll, the third roll cooperating with the second roll for defining therebetween a second nip for the removal of a second portion of the water from the web during passage of the web through the second nip. The third roll is a plain roll. A looped first press felt extends around the first roll and through the first nip such that the first press felt supports the web from the forming wire to the first nip, the first press felt being disposed between the web and the first roll from the forming wire to the first nip.

In a more specific embodiment of the present invention, a first movable guide roll is provided for guiding the first press felt such that when the first movable guide roll is disposed in a first location thereof, the first press felt wraps around the second roll by a first amount of wrap. However, when the first movable guide roll is disposed in a second location thereof, the first press felt wraps around the second roll by a second amount of wrap.

Additionally, the first press felt wraps around the second roll by a variable amount of wrap between the first and the second amount of wrap which is dependent upon movement of the first movable guide roll between the first and the second locations thereof.

A second movable guide roll is provided for guiding the second press felt such that when the second movable guide roll is disposed in a first disposition thereof, the second press felt wraps around the third roll by a first degree of wrap. However, when the second movable guide roll is disposed in a second disposition thereof, the second press felt wraps around the third roll by a second degree of wrap.

Furthermore, the second press felt wraps around the third roll by an adjustable amount of wrap between the first and the second degree of wrap which is dependent upon movement of the second movable guide roll between the first and the second dispositions thereof.

Additionally, a first doctor blade cooperates with the first roll for doctoring the first portion of the water from the first roll.

Also, a first collector is disposed in a vicinity of the first doctor blade for collecting and removing the first portion of the water.

A second doctor blade cooperates with the second roll for doctoring the second portion of the water from the second roll and a second collector is disposed in a further vicinity of the second doctor blade for collecting and removing the second portion of the water.

In a preferred embodiment of the present invention, the third roll is a plain press roll.

Moreover, the web is double felted by the first and the second press felt during passage thereof through the first nip for assisting in the removal therefrom of the first and second portions of the water.

Additionally, the web is single felted by the second press felt during passage thereof through the second nip such that a smooth surface is imparted to a first surface of the web by the plain third press roll during passage thereof through the second nip.

A steam box is disposed adjacent to the second roll for steam heating the web during movement of the web between the first and second nips, the web being disposed between the steam box and the second roll during passage thereof between the first and second nips.

Furthermore, a web removing doctor cooperates with the third roll and is disposed approximately diametrically opposite to the second nip for removing the web from the third roll.

A broke pit is disposed beneath the web removing doctor for collecting the web removed from the third roll.

Additionally, a deflector is attached to the web removing doctor for deflecting the web removed from the third roll towards the broke pit.

Also, a further web removing doctor is disposed between the web removing doctor and the second nip for removal of the web from the third roll.

A movable suction transfer roll is disposed adjacent to the third roll and is disposed downstream relative to the second nip.

Also, a looped transfer felt is guided around the movable suction transfer roll such that when the movable suction transfer roll is disposed in a first position thereof. The third roll and the movable suction transfer roll define therebetween a further nip for a passage therethrough of the web with the web disposed between the third roll and the transfer felt. The arrangement is such that when the movable suction transfer roll is disposed in a second position thereof, the third roll and the movable suction transfer roll define therebetween a gap for an open draw of the web from the third roll to the transfer felt as the transfer felt extends around the movable suction transfer roll.

A frame having a first and a second portion is provided with the movable suction transfer roll being pivotally secured to the first portion of the frame about a first axis of rotation.

A guidance roll is disposed downstream relative to the movable suction transfer roll for guiding the looped transfer felt. The guidance roll is pivotally secured to the second portion of the frame about a second axis of rotation.

Moreover, the frame is pivotally anchored to the third roll about a third axis of rotation which is spaced from the third roll. The third axis of rotation is disposed between the first and the second axes of rotation and the first, second and third axes of rotation are disposed spaced and parallel relative to each other. Also, the first and second axes of rotation orbit about the third axis of rotation when the movable suction transfer roll is moved between the first and the second positions thereof.

A moving device is operatively associated with the frame for selectively pivoting the frame about the third axis of rotation for moving the movable suction transfer roll between the first and the second positions thereof.

Also, a press is disposed downstream relative to the movable suction transfer roll for further pressing the web supported by the looped transfer felt.

The press includes a fourth roll which is disposed downstream relative to the movable suction transfer roll. The fourth roll cooperates with the web such that the looped transfer felt is disposed between the fourth roll and the web.

More specifically, the fourth roll is a suction roll and the press includes a fifth roll which cooperates with the fourth roll for defining therebetween a third nip for a passage therethrough of the web supported by the looped transfer felt.

A third press felt extends through the third nip such that the web is disposed between the looped transfer felt and the third felt during passage thereof through the third nip.

In another embodiment of the present invention, the press is an extended nip press.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

Included in these modifications would be the application of the concept of the present invention to papermaking arrangements including alone or in combination, a dilution control headbox, fourdrinier former, a fourdrinier former together with a hybrid former, multilayer forming sections with multiple headboxes and gap formers with multi-fourdrinier, single and double tiered drying sections, a mix of single and double tier dryer sections, puddle and metering size presses, extensible units for sack paper, hard calendar, soft calendar with single or double stack and pope reel.

BRIEF DESCRIPTION OF THE DRAWINGS

Similar reference characters refer to similar parts throughout the various views and embodiments of the drawings.

DETAILED DESCRIPTION OF THE DRAWINGS

Figure 1:
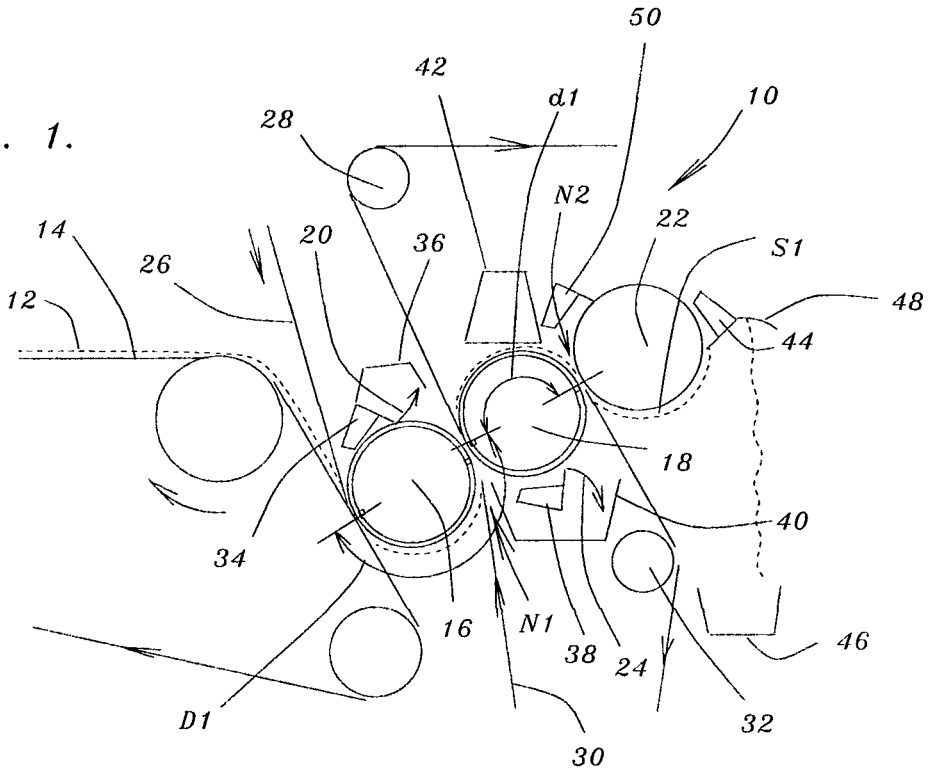
FIG. 1 is a side elevational view of a press apparatus according to the present invention.

FIG. 1 is a side elevational view of a press apparatus generally designated 10 according to the present invention. As shown in FIG. 1, the press apparatus 10 is provided for removing water from a web 12 that has been supported on an upstream forming wire 14. The press apparatus 10 includes a first roll 16 which cooperates with the forming wire 14 for transferring the web 12 from the forming wire 14 to the first roll 16. A second roll 18 is disposed downstream relative to the first roll 16, the second roll 18 cooperating with the first roll 16 for defining therebetween a first nip N1 for the removal of a first portion of the water 20 from the web 12 during passage of the web 12 through the first nip N1. A third roll 22 is disposed downstream relative to the second roll 18, the third roll 22 cooperating with the second roll 18 for defining therebetween a second nip N2 for the removal of a second portion of the water 24 from the web 12 during passage of the web 12 through the second nip N2.

In a more specific embodiment of the present invention the first press roll 16 is a suction roll and even more specifically, the first press roll 16 is a suction press roll.

A looped first press felt 26 extends around the first roll 16 and through the first nip N1 such that the first press felt 26 supports the web 12 from the forming wire 14 to the first nip N1.

Also, the first press felt 26 is disposed between the web 12 and the first roll 16 from the forming wire 14 to the first nip N1.

Furthermore, a first movable guide roll 28 is provided for guiding the first press felt 26 such that when the first movable guide roll 28 is disposed in a first location thereof as shown in FIG. 1, the first press felt 26 wraps around the second roll 18 by a first amount of wrap as indicated by the first peripheral distance D1.

Figure 2:
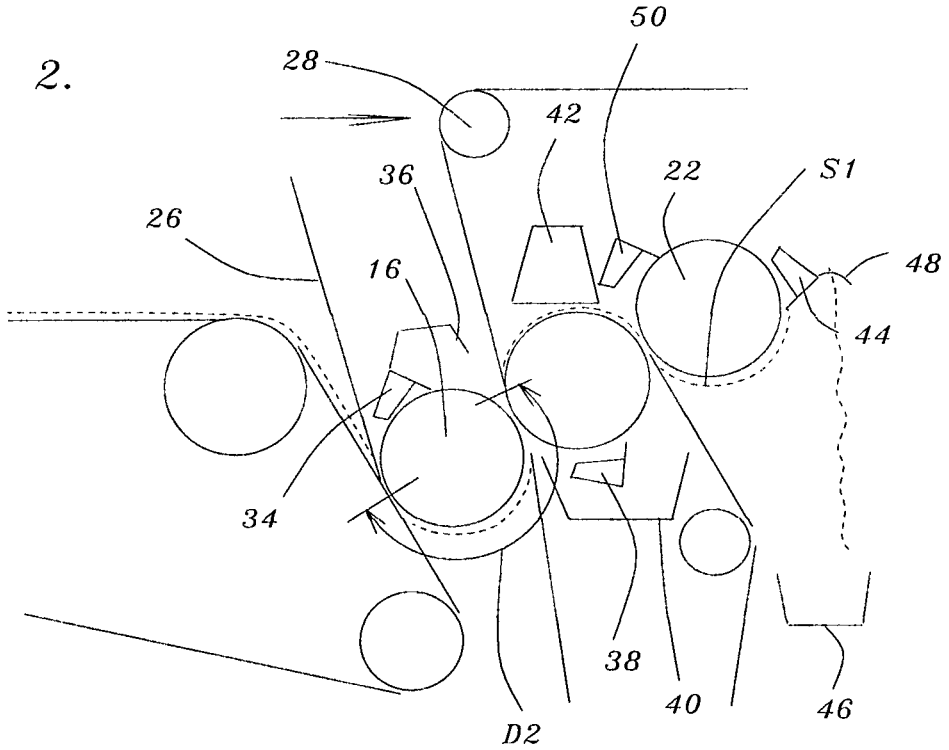
FIG. 2 is a similar view to that shown in FIG. 1 but shows the configuration when the first movable guide roll is disposed in a second location thereof.

FIG. 2 is a similar view to that shown in FIG. 1 but shows the configuration when the first movable guide roll 28 is disposed in a second location thereof. As shown in FIG. 2, the first press felt 26 wraps around the second roll 18 by a second amount of wrap as indicated by the second peripheral distance D2

Additionally, the first press felt 26 wraps around the second roll 18 by a variable amount of wrap between the first amount of wrap D1 and the second amount of wrap D2 which is dependent upon movement of the first movable guide roll 28 between the first and the second locations thereof as shown in FIGS. 1 and 2 respectively.

Moreover, as shown in FIG. 1, a looped second press felt 30 extends around the second roll 18 and through the first nip N1 such that the second press felt 30 supports the web 12 from the first nip N1 to the second nip N2.

Also, the second press felt 30 is disposed between the web 12 and the second roll 18 from the first nip N1 to the second nip N2.

A second movable guide roll 32 is provided for guiding the second press felt 30 such that when the second movable guide roll 32 is disposed in a first disposition thereof as shown in FIG. 1, the second press felt 32 wraps around the third roll 22 by a first degree of wrap as indicated by the first peripheral distance d1.

Figure 3:
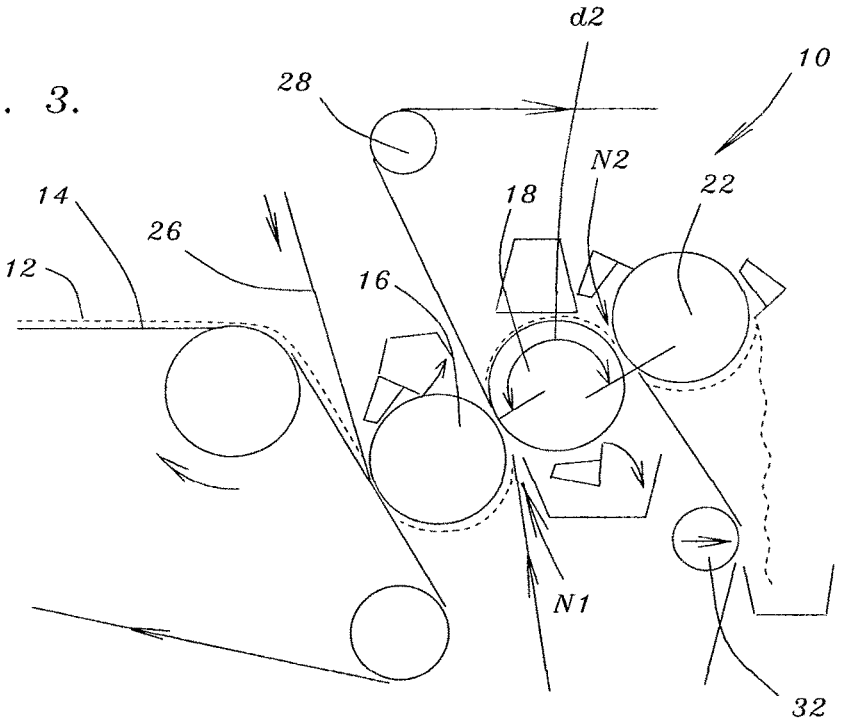
FIG. 3 is a similar view to that shown in FIG. 1 but with the second movable guide roll disposed in a second disposition thereof.

FIG. 3 is a similar view to that shown in FIG. 1. However, as shown in FIG. 3, when the second movable guide roll 32 is disposed in a second disposition thereof, the second press felt 30 wraps around the third roll 22 by a second degree of wrap as indicated by the second peripheral distance d2.

Furthermore, the second press felt 30 wraps around the third roll 22 by an adjustable amount of wrap between the first degree of wrap d1 and the second degree of wrap d2 which is dependent upon movement of the second movable guide roll 32 between the first and the second dispositions thereof as shown in FIGS. 1 and 3 respectively.

Additionally, as shown in FIGS. 1 and 2, a first doctor blade 34 cooperates with the first roll 16 for doctoring the first portion of the water 20 from the first roll 16.

Also, a first collector 36 is disposed in a vicinity of the first doctor blade 34 for collecting and removing the first portion of the water 20.

A second doctor blade 38 cooperates with the second roll 18 for doctoring the second portion of the water 24 from the second roll 18 and a second collector 40 is disposed in a vicinity of the second doctor blade 38 for collecting and removing the second portion of the water 24.

In a preferred embodiment of the present invention, the third roll 22 is a plain press roll.

Moreover, the web 12 is double felted by the first and the second press felt 26 and 30 respectively during passage thereof through the first nip N1 for assisting in the removal therefrom of the first and second portions of the water 20 and 24 respectively.

Additionally, the web 12 is single felted by the second press felt 30 during passage thereof through the second nip N2 such that a smooth surface is imparted to a first surface Si of the web 12 by the plain third press roll 22 during passage thereof through the second nip N2.

A steam box 42 is disposed adjacent to the second roll 18 for steam heating the web 12 during movement of the web 12 between the first and second nips N1 and N2 respectively, the web 12 being disposed between the steam box 42 and the second roll 18 during passage thereof between the first and second nips N1 and N2 respectively.

Furthermore, a web removing doctor 44 cooperates with the third roll 22 and is disposed approximately diametrically opposite to the second nip N2 for removing the web 12 from the third roll 22.

A broke pit 46 is disposed beneath the web removing doctor 44 for collecting the web 12 removed from the third roll 22.

Additionally, a deflector 48 is attached to the web removing doctor 44 for deflecting the web 12 removed from the third roll 22 towards the broke pit 46.

Also, a further web removing doctor 50 is disposed between the web removing doctor 44 and the second nip N2 for removal of the web 12 from the third roll 22.

Figure 4:
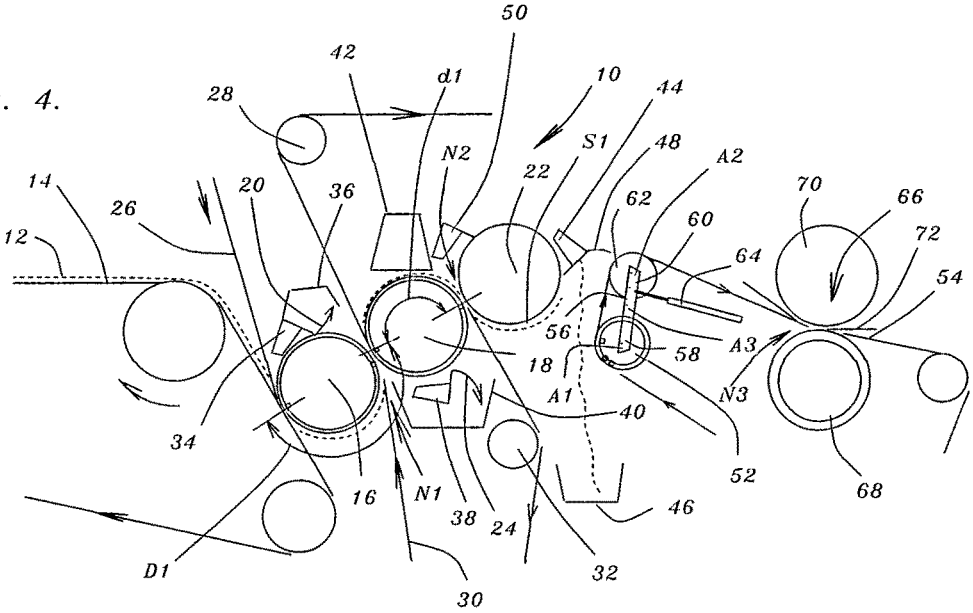
FIG. 4 is a similar view to that shown in FIG. 1 but shows a movable suction transfer roll.

FIG. 4 is a similar view to that shown in FIG. 1 but shows a movable suction transfer roll 52. As shown in FIG. 4, the movable suction transfer roll 52 is disposed adjacent to the third roll 22 and is disposed downstream relative to the second nip N2.

Figure 5:
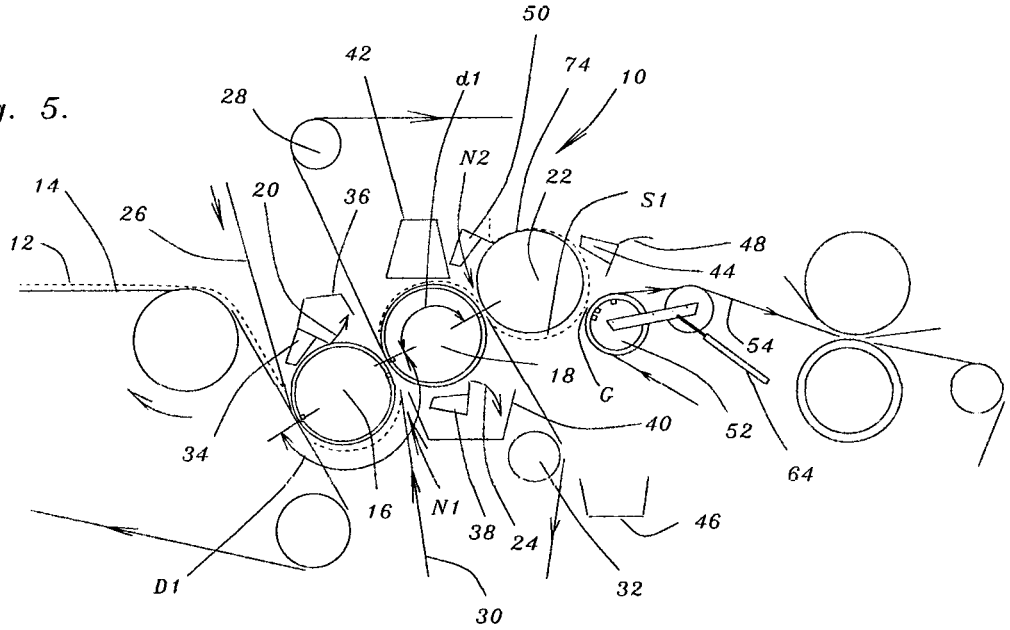
FIG. 5 is a similar view to that shown in FIG. 4 but with the movable suction transfer roll in a different position.

FIG. 5 is a similar view to that shown in FIG. 4 but with the roll 52 in a different position thereof. As shown in FIG. 5, a looped transfer felt 54 is guided around the movable suction transfer roll 52 such that the movable suction transfer roll 52 is disposed in a position thereof such that the movable suction transfer roll 52 approaches the third roll 22 so that the web 12 is disposed between the third roll 22 and the transfer felt 54.

Figure 6:
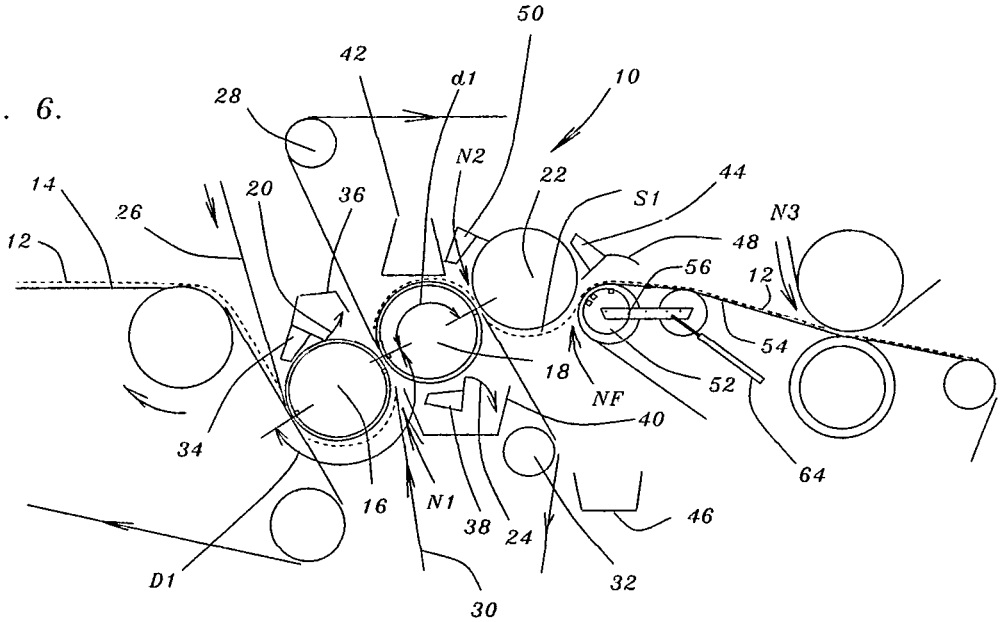
FIG. 6 is a similar view to that shown in FIGS. 4-5 but shows the movable suction transfer roll in a position thereof in which the third roll and the movable suction roll define therebetween a further nip.

FIG. 6 is a similar view to that shown in FIGS. 4-5 but shows the movable suction transfer roll 52 in a position thereof in which the roll 22 and the movable suction roll 52 define therebetween a further nip NF for a passage therethrough of the web 12 with the web 12 disposed between the third roll 22 and the transfer felt 54.

As shown in FIG. 4, the movable roll 52 is shown in a third position thereof whereas in FIG. 5, the roll 52 is shown in a second position thereof with the third roll 22 and the movable suction transfer roll 52 defining therebetween a gap G for an open draw of the web 12 from the third roll 22 to the transfer felt 54.

FIG. 6 shows the roll 52 in a first position for defining the further nip NF.

As shown in FIG. 5, the arrangement is such that when the movable suction transfer roll 52 is disposed in a second position thereof, the third roll 22 and the movable suction transfer roll 52 define therebetween a gap G for an open draw of the web 12 from the third roll 22 to the transfer felt 54 as the transfer felt 54 extends around the movable suction transfer roll 52.

As shown in FIGS. 4-6, a frame 56 has a first portion 58 and a second portion 60. As shown in FIG. 4, the movable suction transfer roll 52 is pivotally secured to the first portion 58 of the frame 56 about a first axis of rotation A1.

A guidance roll 62 is disposed downstream relative to the movable suction transfer roll 52 for guiding the looped transfer felt 54. The guidance roll 62 is pivotally secured to the second portion 60 of the frame 56 about a second axis of rotation A2.

Moreover, the frame 56 is pivotally anchored to the third roll 22 about a third axis of rotation A3 which is spaced from the third roll 22. The arrangement is such that the third axis of rotation A3 is disposed between the first and second axes of rotation A1 and A2 respectively so that the first, second and third axes of rotation A1, A2 and A3 respectively are disposed spaced and parallel relative to each other with the first and second axes of rotation A1 and A2 respectively orbiting about the third axis of rotation A3 when the movable suction transfer roll 52 is moved between the first, second and third positions thereof as shown in FIGS. 6, 5 and 4 respectively.

A moving device 64 is operatively associated with the frame 56 for selectively pivoting the frame 56 about the third axis of rotation A3 for moving the movable suction transfer roll 52 between the first, second and third positions thereof as shown in FIGS. 6, 5 and 4 respectively.

FIGS. 4-6 also show a press generally designated 66 disposed downstream relative to the movable suction transfer roll 52. As shown in FIG. 6, the press 66 is disposed downstream relative to the movable suction transfer roll 52 for further pressing the web 12 supported by the looped transfer felt 54.

The press 66 includes a fourth roll 68 which is disposed downstream relative to the movable suction transfer roll 52. The fourth roll 68 cooperates with the web 12 such that the looped transfer felt 54 is disposed between the fourth roll 68 and the web 12.

More specifically, the fourth roll 68 is a suction roll and the press 66 includes a fifth roll 70 which cooperates with the fourth roll 68 for defining therebetween a third nip N3 for a passage therethrough of the web 12 supported by the looped transfer felt 54.

A third press felt 72 extends through the third nip N3 such that the web 12 is disposed between the looped transfer felt 54 and the third felt 72 during passage thereof through the third nip N3.

Figure 7:
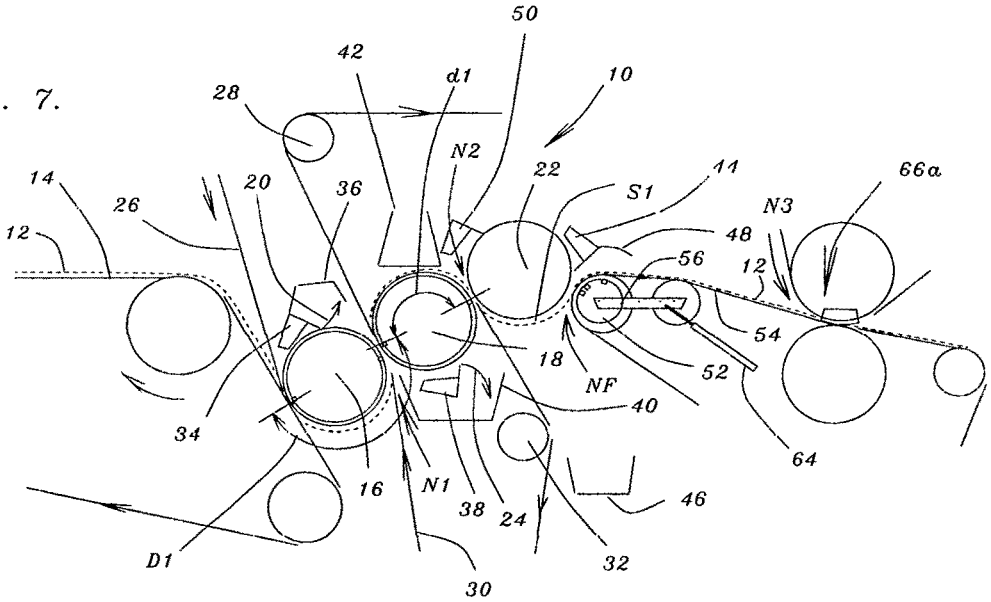
FIG. 7 is a similar view to that shown in FIG. 5 but shows an alternative embodiment of the present invention.

FIG. 7 is a similar view to that shown in FIG. 5 but shows an alternative embodiment of the present invention. As shown in FIG. 6, the press 66*a* is an extended nip press.

Figure 8:
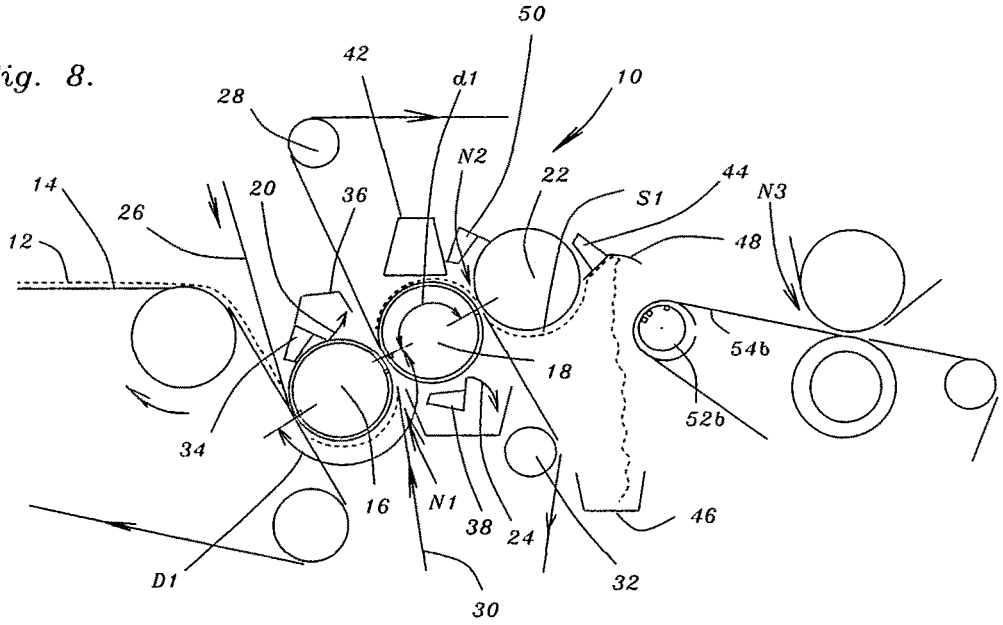
FIG. 8 is a similar view to that shown in FIG. 4 but shows another embodiment of the present invention.

FIG. 8 is a similar view to that shown in FIG. 4 but shows another embodiment of the present invention. As shown in FIG. 8, a movable suction pick up roll 52*b* is shown in a retracted position so that the web on the plain third roll 22 is removed by the doctor blade 44 and is deflected by the deflector 48 into the broke pit 46 until the pressed web 12 has been stabilized through nips N1 and N2.

Figure 9:
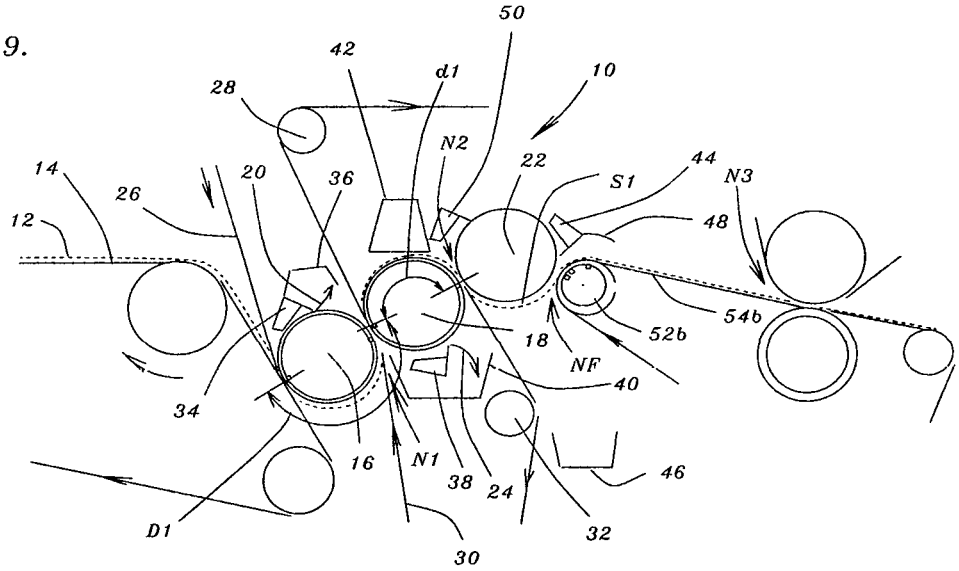
FIG. 9 is a similar view to that shown in FIG. 8 but shows the movable suction pick up roll having been moved to the left.

FIG. 9 is a similar view to that shown in FIG. 8 but shows the movable suction pick up roll 52*b* having been moved to the left after the web 12 has been stabilized so that the movable suction pick up roll 52*b* "kisses" the third roll 22. The suction within the movable suction pick up roll 52*b* draws the web 12 from the smooth surface of the roll 22 onto the transfer felt 54*b* where it is supported and guided towards the third nip N3.

In operation of the apparatus 10, the formed web 12 is picked up from the forming wire 14 by the first press felt 26 extending around the suction pick up roll 16. The web 12 is immediately pressed in nip N1 for removing the first portion of water 20 from the web 12. This first portion of water 20 is doctored from the first suction pickup press roll 16 by the first doctor blade 34 and is collected in the first collector 36 which is a collector pan that may be emptied by gravity or by a suction pump not shown.

The web 12 is double felted during passage thereof through the first nip N1 by the first and second press felts 26 and 30 respectively. The double felting in the first nip N1 is particularly advantageous because this permits the removal of a large amount of water from the formed web during passage through this first nip N1. Also, by combining the function of a pick up roll with that of a first press roll as shown in FIG. 1, the size of the press is far less than a conventional press in which the web travels a considerable distance supported beneath the pick up felt when the pick up felt conveys the web from the pick up roll to the first nip. Additionally, by combining the pick up roll and first press roll functions into the suction pick up press roll 16, the extremely compact press of the present invention reduces the overall cost of the press by providing just one roll 16 rather than a pick up roll and a distinct and separate first press roll.

On exiting from the first nip N1, the web follows the second press felt 30 around the second roll 18 and is steam heated by steam box 42 which heats any water remaining in the web 12. Such steam heating assists in the removal of such remaining water during passage of the web through the second nip N2. Such second portion of water 24 is then doctored from the second roll 18 by the second doctor blade 38 and is collected in the second collector 40.

The web 12 will inherently follow the smooth surface of the third roll 22 when the web exits from the second nip. The smooth surface of the third press roll 22 imparts an advantageous smooth surface to the first surface Si of the web 12 during passage of the web 12 through the second nip N2 thus facilitating subsequent printing on the resultant linerboard or the like.

Until the pressed web 12 has been stabilized on the press apparatus 10, the movable suction transfer roll 52 will be moved by the moving device 64 to the third position thereof as shown in FIG. 4 so that the web removing doctor 44 will remove the web 12 from the third roll 22 and the deflector 48 will deflect such removed web towards the broke pit 46 below.

When the web 12 has been stabilized as shown in FIG. 5, the web removing doctor 44 is refracted from the third roll 22 and simultaneously, the movable suction transfer roll 52 is moved from the third position thereof to the second position thereof as shown in FIG. 5 and then to the first position as shown in FIG. 6 so that the movable suction transfer roll 52 comes lightly into contact with the third roll 22 or "kisses" the third roll 22 to form therebetween the further nip NF. The suction within the movable suction transfer roll 52 causes the stabilized pressed web 12 to transfer from the surface of the third roll 22 onto the transfer felt 54 extending around the movable suction transfer roll 52. The small length of web or tail 74 continuing on the third roll 22 during movement of the movable suction transfer roll 52 from the FIG. 5 position to the FIG. 6 position thereof is doctored from the surface of the third roll 22 by the further web removing doctor 50 as shown in FIG. 5.

Thereafter, the web 12 supported on the transfer felt 54 is guide by the guidance roll 62 towards the press 66 which may be a roll couple press 66 or an extended nip press 66*a*.

The present invention provides a unique and compact press apparatus that provides optimum water removal from the web during passage thereof through the first nip and a smooth upper surface immediately downstream from the second nip.

What is claimed is:

1. A press apparatus for removing water from a web that has been supported on an upstream forming wire, said press apparatus comprising:

a first roll cooperating with the forming wire for transferring the web from the forming wire to said first roll, said first roll being a suction roll;

a second roll disposed downstream relative to said first roll, said second roll cooperating with said first roll for defining therebetween a first nip for the removal of a first portion of the water from the web during passage of the web through said first nip, said second roll being a suction roll;

a third roll disposed downstream relative to said second roll, said third roll cooperating with said second roll for defining therebetween a second nip for the removal of a second portion of the water from the web during passage of the web through said second nip, said third roll being a plain roll;

a looped first press felt extending around said first roll and through said first nip such that said first press felt supports the web from the forming wire to said first nip, said first press felt being disposed between the web and said first roll from the forming wire to said first nip; and a looped second press felt extending around said second roll and through said first nip such that said second press felt supports the web from said first nip to said second nip, said second press felt being disposed between the web and said second roll from said first nip to said second nip.

2. A press apparatus as set forth in claim 1 further including:

a first movable guide roll for guiding said first press felt such that when said first movable guide roll is disposed in a first location thereof, said first press felt wraps around said second roll by a first amount of wrap and when said first movable guide roll is disposed in a second location thereof, said first press felt wraps around said second roll by a second amount of wrap.

3. A press apparatus as set forth in claim 2 wherein said first press felt wraps around said second roll by a variable amount of wrap between said first and said second amount of wrap which is dependent upon movement of said first movable guide roll between said first and said second locations thereof.

4. A press apparatus as set forth in claim 1 further including:

a second movable guide roll for guiding said second press felt such that when said second movable guide roll is disposed in a first disposition thereof, said second press felt wraps around said third roll by a first degree of wrap and when said second movable guide roll is disposed in a second disposition thereof, said second press felt wraps around said third roll by a second degree of wrap.

5. A press apparatus as set forth in claim 4 wherein said second press felt wraps around said third roll by an adjustable amount of wrap between said first and said second degree of wrap which is dependent upon movement of said second movable guide roll between said first and said second dispositions thereof.

6. A press apparatus as set forth in claim 1 further including:

a first doctor blade cooperating with said first roll for doctoring said first portion of the water from said first roll;

a first collector disposed in a vicinity of said first doctor blade for collecting and removing said first portion of the water.

7. A press apparatus as set forth in claim 1 further including:

a second doctor blade cooperating with said second roll for doctoring said second portion of the water from said second roll;

a second collector disposed in a further vicinity of said second doctor blade for collecting and removing said second portion of the water.

8. A press apparatus as set forth in claim 1 wherein the web is double felted by said first and said second press felt during passage thereof through said first nip for assisting in the removal therefrom of said first and second portions of the water.

9. A press apparatus as set forth in claim 8 wherein the web is single felted by said second press felt during passage thereof through said second nip such that a smooth surface is imparted to a first surface of the web by said plain third press roll during passage thereof through said second nip.

10. A press apparatus as set forth in claim 1 further including:

a steam box disposed adjacent to said second roll for steam heating the web during movement of the web between said first and second nip, the web being disposed between said steam box and said second roll during passage thereof between said first and second nips.

11. A press apparatus as set forth in claim 1 further including:

a web removing doctor cooperating with said third roll and disposed approximately diametrically opposite to said second nip for removing the web from said third roll;

a broke pit disposed beneath said web removing doctor for collecting the web removed from said third roll;

a deflector attached to said web removing doctor for deflecting the web removed from said third roll towards said broke pit;

a further web removing doctor disposed between said web removing doctor and said second nip for removal of the web from said third roll.

12. A press apparatus as set forth in claim 1 further including:

a movable transfer roll disposed adjacent to said third roll and downstream relative to said second nip;

a looped transfer felt guided around said movable transfer roll such that when said movable transfer roll is disposed in a first position thereof, said third roll and said movable transfer roll define therebetween a further nip for a passage therethrough of the web with the web disposed between said third roll and said transfer felt and so that when said movable transfer roll is disposed in a second position thereof, said third roll and said movable transfer roll define therebetween a gap for an open draw of the web from said third roll to said transfer felt as said transfer felt extends around said movable transfer roll.

13. A press apparatus as set forth in claim 12 wherein said movable transfer roll is a suction roll.

14. A press apparatus as set forth in claim 13 further including:

a frame having a first and a second portion, said movable suction transfer roll being pivotally secured to said first portion of said frame about a first axis of rotation;

a guidance roll disposed downstream relative to said movable suction transfer roll for guiding said looped transfer felt, said guidance roll being pivotally secured to said second portion of said frame about a second axis of rotation;

said frame being pivotally anchored to said third roll about a third axis of rotation which is spaced from said third roll so that said third axis of rotation is disposed between said first and second axes of rotation such that said first, second and third axes of rotation are disposed spaced and parallel relative to each other with said first and second axes of rotation orbiting about said third axis of rotation when said movable suction transfer roll is moved between said first and said second positions thereof;

a moving device operatively associated with said frame for selectively pivoting said frame about said third axis of rotation for moving said movable suction transfer roll between said first and said second positions thereof.

15. A press apparatus as set forth in claim 13 further including:

a press disposed downstream relative to said movable suction transfer roll for further pressing the web supported by said looped transfer felt.

16. A press apparatus as set forth in claim 15 wherein said press includes:

a fourth roll disposed downstream relative to said movable suction transfer roll, said fourth roll cooperating with the web such that said looped transfer felt is disposed between said fourth roll and the web.

17. A press apparatus as set forth in claim 16 wherein said fourth roll is a suction roll.

18. A press apparatus as set forth in claim 16 wherein said press includes:

a fifth roll which cooperates with said fourth roll for defining therebetween a third nip for a passage therethrough of the web supported by said looped transfer felt.

19. A press apparatus as set forth in claim 18 further including:

a third press felt extending through said third nip such that the web is disposed between said looped transfer felt and said third felt during passage thereof through said third nip.

20. A press apparatus as set forth in claim 15 wherein said press is an extended nip press.

21. A press apparatus for removing water from a web that has been supported on an upstream forming wire, said press apparatus comprising:

a first roll cooperating with the forming wire for transferring the web from the forming wire to said first roll;

a second roll disposed downstream relative to said first roll, said second roll cooperating with said first roll for defining therebetween a first nip for the removal of a first portion of the water from the web during passage of the web through said first nip;

a third roll disposed downstream relative to said second roll, said third roll cooperating with said second roll for defining therebetween a second nip for the removal of a second portion of the water from the web during passage of the web through said second nip;

said first press roll being a suction press roll;

a looped first press felt extending around said first roll and through said first nip such that said first press felt supports the web from the forming wire to said first nip;

said first press felt being disposed between the web and said first roll from the forming wire to said first nip;

a first movable guide roll for guiding said first press felt such that when said first movable guide roll is disposed in a first location thereof, said first press felt wraps around said second roll by a first amount of wrap and when said first movable guide roll is disposed in a second location thereof, said first press felt wraps around said second roll by a second amount of wrap;

said first press felt wraps around said second roll by a variable amount of wrap between said first and said second amount of wrap which is dependent upon movement of said first movable guide roll between said first and said second locations thereof;

a looped second press felt extending around said second roll and through said first nip such that said second press felt supports the web from said first nip to said second nip; and said second press felt being disposed between the web and said second roll from said first nip to said second nip.

22. A press apparatus for removing water from a web that has been supported on an upstream forming wire, said press apparatus comprising:

a first roll cooperating with the forming wire for transferring the web from the forming wire to said first roll;

a second roll disposed downstream relative to said first roll, said second roll cooperating with said first roll for defining therebetween a first nip for the removal of a first portion of the water from the web during passage of the web through said first nip;

a third roll disposed downstream relative to said second roll, said third roll cooperating with said second roll for defining therebetween a second nip for the removal of a second portion of the water from the web during passage of the web through said second nip;

said first press roll being a suction press roll;

a looped first press felt extending around said first roll and through said first nip such that said first press felt supports the web from the forming wire to said first nip;

said first press felt being disposed between the web and said first roll from the forming wire to said first nip;

a first movable guide roll for guiding said first press felt such that when said first movable guide roll is disposed in a first location thereof, said first press felt wraps around said second roll by a first amount of wrap and when said first movable guide roll is disposed in a second location thereof, said first press felt wraps around said second roll by a second amount of wrap;

said first press felt wraps around said second roll by a variable amount of wrap between said first and said second amount of wrap which is dependent upon movement of said first movable guide roll between said first and said second locations thereof;

a looped second press felt extending around said second roll and through said first nip such that said second press felt supports the web from said first nip to said second nip;

said second press felt is disposed between the web and said second roll from said first nip to said second nip;

a second movable guide roll for guiding said second press felt such that when said second movable guide roll is disposed in a first disposition thereof, said second press felt wraps around said third roll by a first degree of wrap and when said second movable guide roll is disposed in a second disposition thereof, said second press felt wraps around said third roll by a second degree of wrap;

said second press felt wraps around said third roll by an adjustable amount of wrap between said first and said second degree of wrap which is dependent upon movement of said second movable guide roll between said first and said second dispositions thereof;

a first doctor blade cooperating with said first roll for doctoring said first portion of the water from said first roll;

a first collector disposed in a vicinity of said first doctor blade for collecting and removing said first portion of the water;

a second doctor blade cooperating with said second roll for doctoring said second portion of the water from said second roll;

a second collector disposed in a further vicinity of said second doctor blade for collecting and removing said second portion of the water;

said third roll being a plain press roll;

the web is double felted by said first and said second press felt during passage thereof through said first nip for assisting in the removal therefrom of said first and second portions of the water;

the web is single felted by said second press felt during passage thereof through said second nip such that a smooth surface is imparted to a first surface of the web by said plain third press roll during passage thereof through said second nip;

a steam box disposed adjacent to said second roll for steam heating the web during movement of the web between said first and second nip, the web being disposed between said steam box and said second roll during passage thereof between said first and second nips;

a web removing doctor cooperating with said third roll and disposed approximately diametrically opposite to said second nip for removing the web from said third roll;

a broke pit disposed beneath said web removing doctor for collecting the web removed from said third roll;

a deflector attached to said web removing doctor for deflecting the web removed from said third roll towards said broke pit;

a further web removing doctor disposed between said web removing doctor and said second nip for removal of the web from said third roll;

a movable suction transfer roll disposed adjacent to said third roll and downstream relative to said second nip;

a looped transfer felt guided around said movable suction transfer roll such that when said movable suction transfer roll is disposed in a first position thereof, said third roll and said movable suction transfer roll define therebetween a further nip for a passage therethrough of the web with the web disposed between said third roll and said transfer felt and so that when said movable suction transfer roll is disposed in a second position thereof, said third roll and said movable suction transfer roll define therebetween a gap for an open draw of the web from said third roll to said transfer felt as said transfer felt extends around said movable suction transfer roll;

a frame having a first and a second portion, said movable suction transfer roll being pivotally secured to said first portion of said frame about a first axis of rotation;

a guidance roll disposed downstream relative to said movable suction transfer roll for guiding said looped transfer felt, said guidance roll being pivotally secured to said second portion of said frame about a second axis of rotation;

said frame being pivotally anchored to said third roll about a third axis of rotation which is spaced from said third roll so that said third axis of rotation is disposed between said first and second axes of rotation such that said first, second and third axes of rotation are disposed spaced and parallel relative to each other with said first and second axes of rotation orbiting about said third axis of rotation when said movable suction transfer roll is moved between said first and said second positions thereof;

a moving device operatively associated with said frame for selectively pivoting said frame about said third axis of rotation for moving said movable suction transfer roll between said first and said second positions thereof;

a press disposed downstream relative to said movable suction transfer roll for further pressing the web supported by said looped transfer felt;

said press including:

a fourth roll disposed downstream relative to said movable suction transfer roll, said fourth roll cooperating with the web such that said looped transfer felt is disposed between said fourth roll and the web;

said fourth roll being a suction roll;

said fifth roll cooperating with said fourth roll for defining therebetween a third nip for a passage therethrough of the web supported by said looped transfer felt; and said third press felt extending through said third nip such that the web is disposed between said looped transfer felt and said third felt during passage thereof through said third nip.

* * * * *